United States Patent [19]

Sartor

[11] Patent Number: 4,669,203

[45] Date of Patent: Jun. 2, 1987

[54] SKI BOOT INCORPORATING AN INCLINATION ADJUSTMENT DEVICE

[75] Inventor: Mariano Sartor, Montebelluna, Italy

[73] Assignee: Nordica S.p.A., Montebelluna, Italy

[21] Appl. No.: 821,315

[22] Filed: Jan. 22, 1986

[30] Foreign Application Priority Data

Feb. 1, 1985 [IT] Italy ..... 20677/85[U]

[51] Int. Cl.[4] ..... A43B 5/04

[52] U.S. Cl. ..... 36/120; 36/121

[58] Field of Search ..... 36/117–121

[56] References Cited

U.S. PATENT DOCUMENTS 4,523,395 6/1985 Borsoi ..... 36/119

FOREIGN PATENT DOCUMENTS 0117488 9/1984 European Pat. Off. ..... 36/117
0133237 2/1985 European Pat. Off. ..... 36/117
0166213 1/1986 European Pat. Off. ..... 36/117
2557776 7/1985 France ..... 36/117

*Primary Examiner*—James Kee Chi
*Attorney, Agent, or Firm*—Guido Modiano; Albert Josif

[57] ABSTRACT

The ski boot comprises a shell, a front quarter and a rear quarter hingedly connected to said shell, and a device for adjusting the inclination of the front quarter relatively to the shell. The peculiar aspect of the invention is that the cited inclination adjustment device includes a detent associated with the quarter and interacting with the shell. Also provided is an actuation element for locating the detent, with access from the boot exterior, at a front portion of the boot.

5 Claims, 4 Drawing Figures

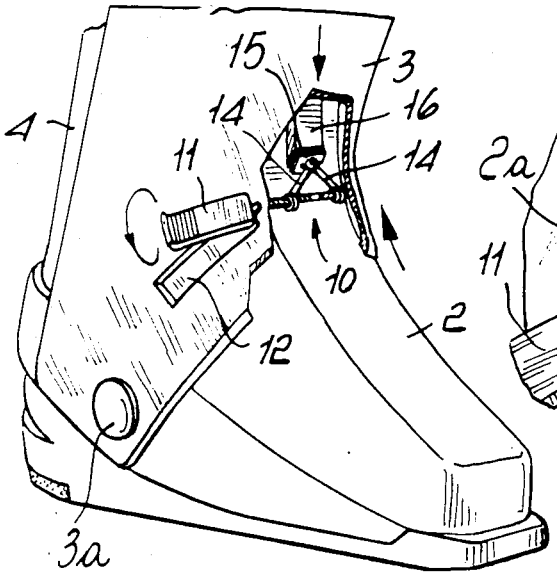
Fig. 1
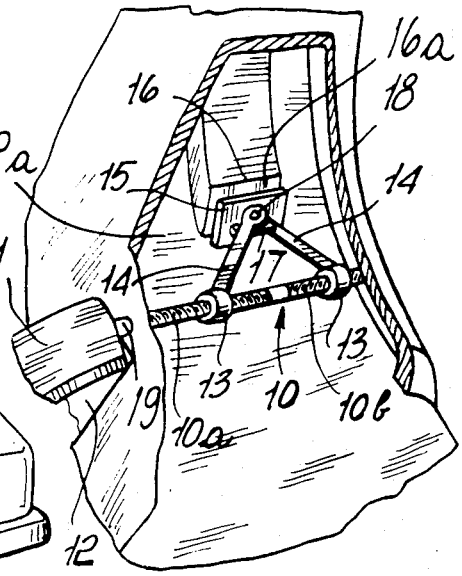
Fig. 2
1
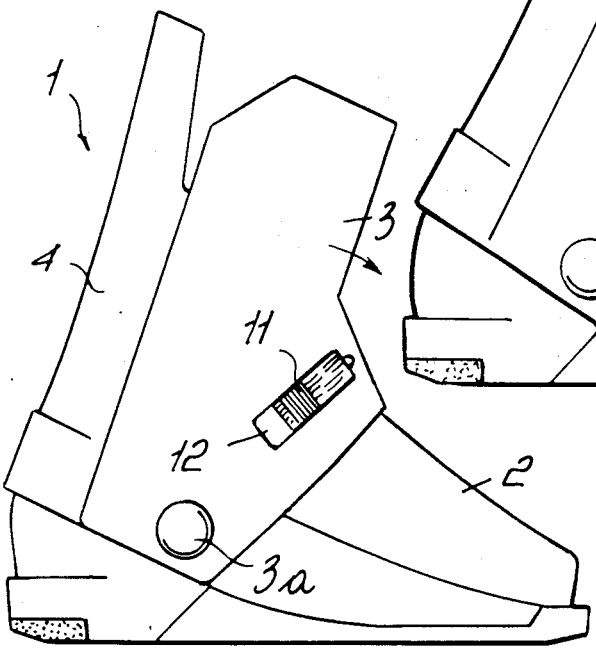
Fig. 3
Fig. 4
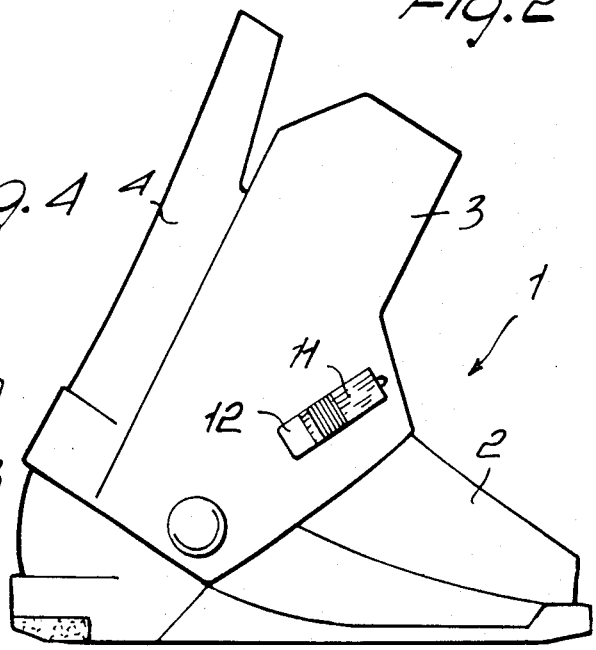

SKI BOOT INCORPORATING AN INCLINATION ADJUSTMENT DEVICE

BACKGROUND OF THE INVENTION

This invention relates to a ski boot incorporating an inclination adjustment device.

As is known, particularly in the construction of rear entrance ski boots, it is customary to incorporate a device for adjusting the boot's inclination.

The term inclination or rake refers herein to the angle formed by the axis of the front quarter from the vertical line which extends perpendicularly to the boot sole, by rotation about a substantially horizontal and perpendicular axis to the longitudinal extension of the boot sole.

It is current practice in ski boot manufacture to provide for such adjustment means which are relatively complex and not generally easily accessable by the user.

Another disadvantage of prior approaches is that the application of such adjustment devices involves considerable assembly problems, and in many cases, requires alteration of the typical design of a ski boot.

SUMMARY OF THE INVENTION

It is the aim of this invention to overcome such prior disadvantages by providing a ski boot incorporating an inclination adjustment device which affords a simple and quick adjustment of the inclination even in adverse environmental conditions, such as those typically encountered when skiing.

Within the above aim, it is a particular object of the invention to provide a ski boot incorporating an inclination adjustment device, wherein the adjustment means can easily be assembled on the boot without involving any special alteration of the boot's traditional design.

Another object of this invention is to provide a ski boot incorporating an inclination adjustment device which, owing to its peculiar constructional features, can give full assurance of being reliable and safe to use.

A not least object of this invention is to provide a ski boot incorporating an inclination adjustment device, which can be easily manufactured from commercially readily available elements and materials, and be highly competitive from a purely economical standpoint.

The above aim, and these and other objects to become apparent hereinafter, are achieved by a ski boot incorporating an inclination adjustment device, according to the invention, comprising a shell, at least one front quarter hingedly connected to said shell, and a means of adjusting the inclination angle of said quarter relatively to said shell, characterized in that said inclination adjustment device includes a detent associated with said quarter and interacting with said shell, there being further provided an actuating element for locating said detent, with access from the exterior of said boot, at a front portion thereof.

BRIEF DESCRIPTION OF THE DRAWINGS

Further features and advantages will be apparent from the following detailed description of a ski boot incorporating an inclination adjustment device, with reference to the accompanying illustrative and non-limitative drawing, where:

FIG. 1 is a partly cut-away perspective view of the ski boot incorporating an inclination adjustment device according to the invention;

FIG. 2 is a fragmentary, partly cut-away perspective view showing the inclination adjusting device;

FIGS. 3 and 4 show diagrammatically the ski boot at two different inclination settings of the front quarter with respect to the boot shell.

DESCRIPTION OF THE PREFERRED EMBODIMENTS

With reference to the drawing figures, the ski boot according to the invention, generally designated with the reference numeral 1, has a shell 2 on which a front quarter 3 and a rear quarter 4 are articulated in 3*a* in a manner known per se. The articulation 3*a* defines the rake axis.

On the front quarter 3 there is provided a retractable expansion mechanism or device for adjusting the inclination or rake of the quarter which is advantageously actuated through an actuating element consisting of a rod 10, with oppositely handed threaded portions 10*a*, 10*b*, which is supported rotatably in the forward portion of the quarter 3, such that it is positioned between the quarter itself and the shell 2. It will be understood that rod 10 has also the function of a backing member for the retractable expansion mechanism.

At one end of the rod 10, protruding externally of the quarter 3 through a hole 19 formed at a lateral portion thereof, a grip and actuating handle or lever 11 is provided which is advantageously pivoted in a conventional manner on the protruding end of the rod 10, and when not being operated, can be folded to fit in a depression 12 formed in the outer lateral surface of the front quarter. The other end of the rod 10 opposite the handle 11 is rotatably accommodated in an appropriate housing for example a substantially cylindrical shaped housing formed internally at a lateral portion of the quarter 3 opposite that wherein said hole 19 is formed.

In order to prevent the end of the rod opposite the actuating handle from coming out of its housing at the interior of the quarter 3, any suitable centering or retaining means may be provided on the rod 10. For example, the rod may be formed with circumferential grooves adapted to accommodate circlips adjacent to the internal lateral walls of the quarter 3, or the rod 10 may be provided with alternative means such as an enlarged or shaped end adapted to rotatably snap fit, either directly, into the cited housing formed at the interior of the quarter 3, or into a bushing or similar bearing means associated therewith.

With the oppositely handed threaded portions, 10*a* and 10*b*, of the rod 10 there threadedly engage two engagement means in the form of nuts 13 which are blocked against rotation, as will be explained hereinafter, thereby on turning the rod 10, the nuts are moved linearly in opposite directions.

On the nuts 13 there are articulated, through pins, screws or the like articulatory connection means, a pair of small connecting rods 14 which are mutually articulated and connected, at the other ends thereof, to the tab 17, protruding from one face of a detent 15, through a pin 18, said detent advantageously comprising a small plate adapted for interacting, at a face thereof opposite to said tab 17, with the shell 2.

More detailedly, the small plate forming the detent 15 acts as an engagement means which may be brought into abutment engagement with a stop elevation or abutment 16, rigidly associated with th shell 2, or formed integrally therewith and having an abutment surface 16*a* extending transverse to the surface area 2*a* of the shell from which the abutment 16 project.

Resultantly, with the above-described arrangement, by operating the actuating handle 11 and turning the rod 10, the nuts are caused to approach each other toward the middle of the rod 10, by virtue of their thread engagement relationship with the oppositely handed threaded portions 10*a*, 10*b*, thereof. Thus, with the rod being rotated in one direction, the two nuts 13 and the ends of the connecting rods 14 articulated thereto will move towards each other causing the opposite ends of the connecting rods articulated to the tab 17 of the detent 15 to move away from the rod 10 and cause it to abut against the elevation 16 thereby increasing the inclination angle of the quarter with respect to the shell.

Conversely, as the rod 10 is turned in the opposite direction, reverse movement of the members of the inclination adjustment device occur, thus the nuts 13 are moved toward the ends of the rod 10, and consequently, the small plate 15 forming the detent is brought closer to the rod 10 and the inclination angle between the shell and the quarter is decreased.

It may be appreciated from the foregoing description that the invention achieves the objects set forth, and in particular the fact should be emphasized that by merely operating the handle 10, the inclination angle can be readily adjusted without any complex handling, in that the handle 11 can be easily operated even while donning mittens or gloves.

Another important aspect of the invention is then that the structural members employed are simple and adapted to be accommodated at a zone which is subjected to no shock or damage during the practice of skiing, since the threaded rod 10 that forms the actuating element is interposed to the front quarter 3 and the shell 2.

In practicing the invention, the materials used, so long as compatible with the intended application, and the dimensions and contingent shapes, may be any appropriate ones.

I claim:

1. In a ski boot having a longitudinal extension and a widthwise extension and including a shell with at least a raking front quarter and with articulation means defining a rake axis, said rake axis extending in the direction of said widthwise extension, said front quarter being articulated on said shell by means of said articulation means and rakeable above said rake axis, a device for adjusting the rake of said quarter, comprising:

an abutment formation rigid with a surface area of said shell and arranged at a distance from said rake axis, said abutment formation having an abutment surface extending transverse to said surface area, a backing member on said front quarter at a longitudinal distance from said abutment formation and a retractable expansion mechanism between said abutment formation and said backing member and having first engagement means on one and thereof in engagement with said abutment formation and second engagement means on an opposite end of said retractable engagement mechanism in engagement with said backing member and expandable connection means between said first and said second engagement means to approach upon actuation of said retractable expansion mechanism said backing member towards and alternatively move away said backing member from said abutment formation and thereby adjust the rake angle of said quarter with respect to said shell, said expansion mechanism having actuation means thereof which are accessible from the outside.

2. A device according to claim 1, wherein said first engagement means are in the form of a detent member in engagement with said abutment formation, said backing member is a rod member rotatably supported on said front quarter and having oppositely handed thread portions and said second engagement means are a pair of nut members in threaded engagement with said oppositely handed thread portions and wherein said expandable connection means comprise a pair of connecting rods each articulated with one end thereof to one of said nuts and with another oppposite end thereof articulated to said detent member, thereby upon rotation of said rod member in one direction to move said nut members relative to each other in first mutually opposite directions along said rod member and change the inclination of said connecting rods with respect to said rod member to thereby increase the mutual distance between said rod member and said abutment formation and thereby increase the rake angle of said front quarter and upon rotation of said rod member in an opposite direction to move said nut members relative to each other in second mutually opposite directions along said rod member and oppositely change the inclination of said connecting rods with respect to said rod member to thereby decrease the mutual distance between said rod member and said abutment formation and thereby decrease the rake angle of said front quarter.

3. A device according to claim 1, further comprising on the outside of said ski boot an actuating handle fixed on one end of said rod member for manual rotation of said rod member.

4. A device according to claim 3, further comprising a depression on an external surface of said front quarter facing said actuating handle for removably accomodating said handle therein.

5. In a ski boot having a longitudinal extension and a widthwise extension and including a shell with at least a raking front quarter and with articulation means defining a rake axis, said rake axis extending in the direction of said widthwise extension, said front quarter being articulated on said shell by means of said articulation means and rakeable about said rake axis, a device for adjusting the rake of said quarter, comprising:

an abutment formation rigid with said shell and arranged at a distance from said rake axis, said abutment formation having an abutment surface extending transverse to said surface area, a blocking member on said front quarter at a longitudinal distance from said abutment formation and a retractable expansion mechanism between said abutment formation and said backing member and having first engagement means on one and thereof in engagement with said abutment formation, second engagement means on an opposite end of said retractable engagement mechanism in engagement with said backing member and expandable connection means between said first and said second engagement means to approach upon actuation of said retractable expansion mechanism said backing member towards and alternatively move away said backing member from said abutment formation and thereby adjust the rake angle of said quarter with respect to said shell, said expansion mechanism having actuation means thereof which are accessible from the outside and wherein said first engagement means are in the form of a detent member in engagement with said abutment formation, said backing member is a rod member rotatably supported on said front quarter and having oppositely handed thread portions and said second engagement means are a pair of nut members in threaded engagement with said oppositely handed thread portions and wherein said expandable connection means comprise a pair of connecting rods each articulated with one end thereof to one of said nuts and with another opposite end thereof articulated to said detent member, thereby upon rotation of said rod member in one direction to move said nut members relative to each other in first mutually opposite directions along said rod member and change the inclination of said connecting rods with respect to said rod member to thereby increase the mutual distance between said rod member and said abutment formation and thereby increase the rake angle of said front quarter and upon rotation of said rod member in an opposite direction to move said nut members relative to each other in second mutually opposite directions along said rod member and oppositely change the inclination of said connecting rods with respect to said rod member to thereby decrease the mutual distance between said rod member and said abutment formation and thereby decreasing the rake angle of said front quarter and wherein said retractable expansion device further comprising on the outside of said ski boot an actuating handle fixed on one end of said rod member for manual rotation of said rod member.

* * * * *